United States Patent [19]

Bush et al.

[11] Patent Number: 4,534,109

[45] Date of Patent: Aug. 13, 1985

[54] SCISSORS

[75] Inventors: Thomas J. Bush, Canton Center, Conn.; Charles L. Dellinger, Statesville; Gerald P. Fregeolle, Hickory, both of N.C.

[73] Assignee: Hunt Manufacturing Co., Philadelphia, Pa.

[21] Appl. No.: 533,460

[22] Filed: Sep. 19, 1983

[51] Int. Cl.[3] ..... B26B 13/00; B26B 13/12; B26B 13/06

[52] U.S. Cl. ..... 30/260; 30/230; 30/254

[58] Field of Search ..... 30/226, 230, 252, 254, 30/260, 266, 341, 349

[56] References Cited

U.S. PATENT DOCUMENTS

| | | | |
|---|---|---|---|
| 1,696,323 | 12/1928 | Patrick | 30/349 |
| 2,286,874 | 6/1942 | Schwartz | 30/230 X |
| 2,377,906 | 6/1945 | Schaaff | 30/349 |
| 2,511,187 | 6/1950 | Weidauer | 30/230 |
| 2,584,603 | 2/1952 | McMillan et al. | 30/349 |
| 2,639,504 | 5/1953 | May | 30/260 |
| 2,737,718 | 3/1956 | Maunu | 30/260 |
| 3,548,496 | 12/1970 | Van Hook | 30/349 |
| 4,250,620 | 2/1981 | Mishikawa | 30/254 |

*Primary Examiner*—Paul A. Bell
*Assistant Examiner*—Paul M. Heyrana, Sr.
*Attorney, Agent, or Firm*—John F. A. Earley; John F. A. Earley, III

[57] ABSTRACT

A scissors has first and second arms with each arm having a finger receiving portion at one end. There is a removable metal blade having an outer edge and an inner cutting edge for each arm. A flange on each arm abuts the outer edge of the respective blade. A pair of inward projections on each flange each has a forwardly extending nose portion and a sloping rear portion and is engaged in a complementary opening in the adjacent blade. A finger extending inwardly from the forward end of each flange overlies a portion of the adjacent blade and is adapted to be engaged by the blade of the other arm when the scissors is in the closed position. A pivot structure passes through the arms and blades securing them together.

5 Claims, 7 Drawing Figures

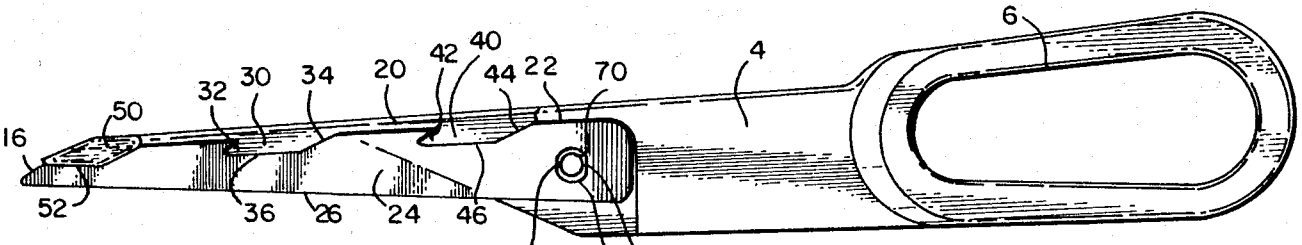
FIG. 3
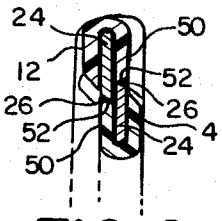
FIG. 6
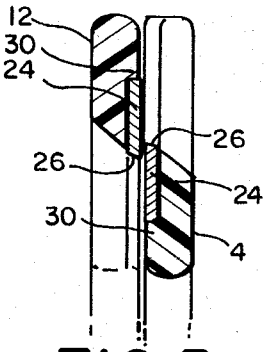
FIG. 5
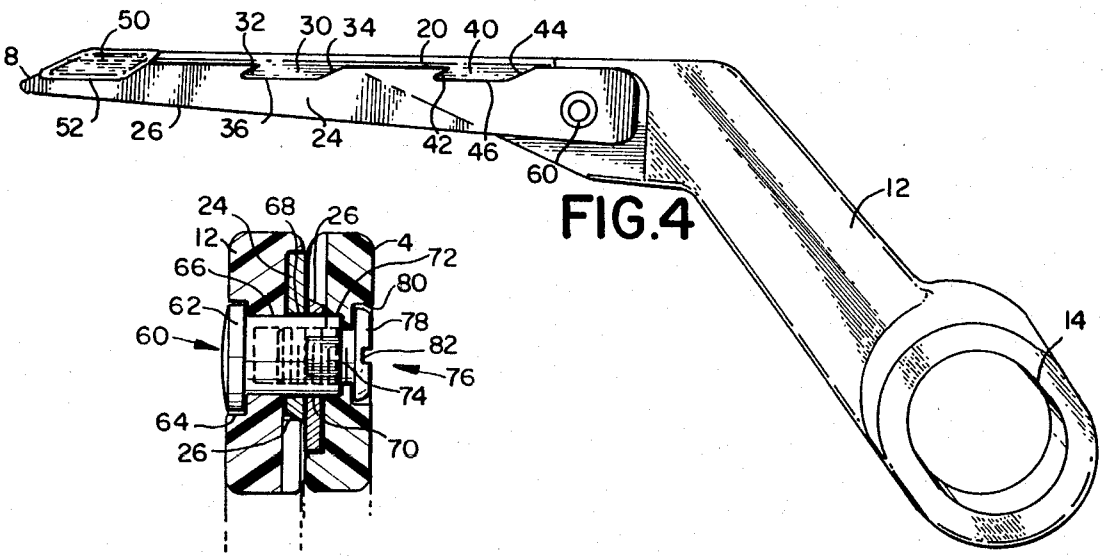
FIG. 4
FIG. 7

SCISSORS

TECHNICAL FIELD

This invention is in the field of cutting tools.

BAKGROUND OF THE PRIOR ART

Scissors having plastic arms with removable metal cutting blades are well-known to the art. Reference may be had to U.S. Pat. No. 4,193,189 and the patents cited therein for such scissors. In U.S. Pat. No. 4,193,189 each blade is held in position against an undercut portion of the arm by a plurality of upstanding bosses on the arm which are in registry with openings in the blade. It is difficult for the ordinary user to remove and insert a blade in these scissors.

This invention provides means for securing replaceable blades in scissors which holds the blade securely and yet permits an ordinary user to remove and replace the blades with ease without the use of any special tools.

BRIEF SUMMARY OF THE INVENTION

A scissors has first and second arms with each arm having a finger receiving portion at one end. There is a removable metal blade having an outer edge and an inner edge for each arm. A flange on each arm abuts the outer edge of the respective blade. A pair of inward projections on each flange each has a forwardly extending nose portion and a sloping rear portion and is engaged in a complementary opening in the adjacent blade. A finger extending inwardly from the forward end of each flange overlies a portion of the adjacent blade and is adapted to be engaged by the blade of the other arm when the scissors is in the closed position. A pivot structure passes through the arms and blades securing them together.

BRIEF DESCRIPTION OF THE DRAWINGS

FIG. 3 is a plan view of the inside of one of the arms of the scissors of FIG. 1.

FIG. 4 is a plan view of the inside of the other arm of the scissors of FIG. 1.

FIG. 5 is a vertical section taken on the plane indicated by the line 5—5 in FIG. 1.

FIG. 6 is a vertical section taken on the plane indicated by the line 6—6 in FIG. 1; and, FIG. 7 is a vertical section taken on the plane indicated by the line 7—7 in FIG. 1.

DETAILED DESCRIPTION

Figure 1:
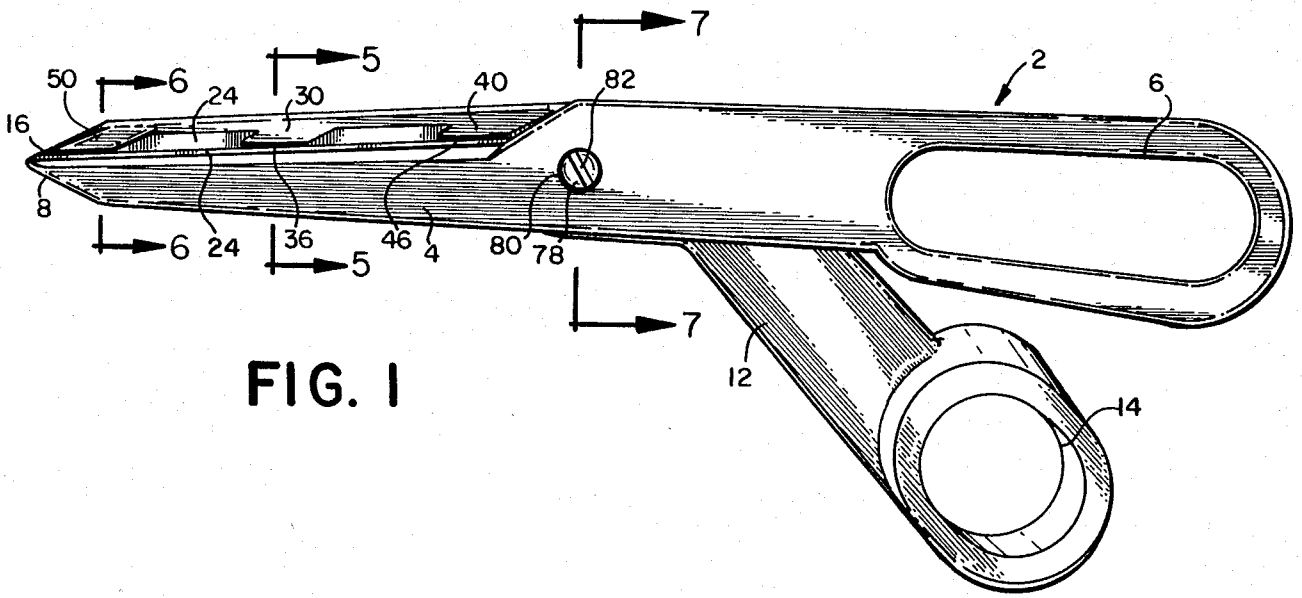
FIG. 1 is a top plan view of a scissors in accordance with the invention in the closed position.
Figure 2:
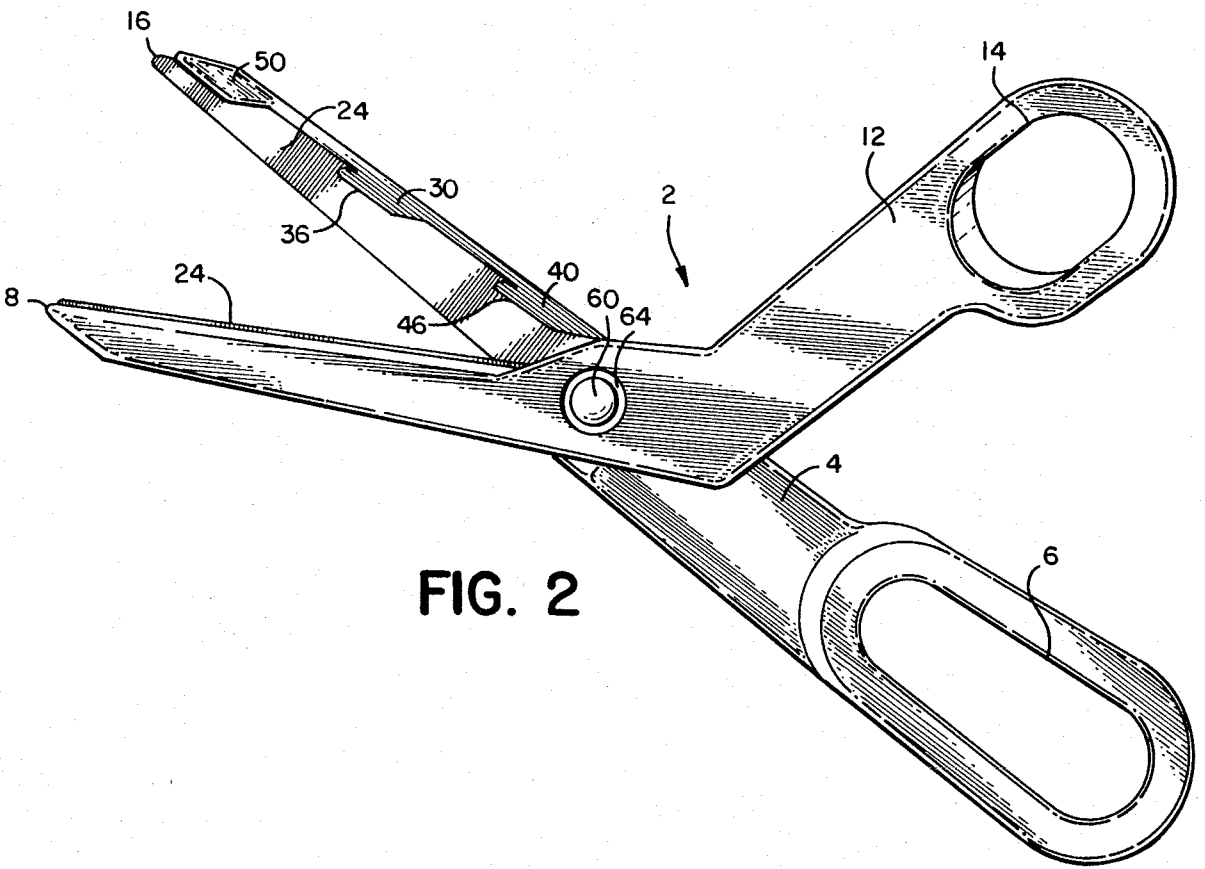
FIG. 2 is a bottom plan view of the scissors of FIG. 1 partially open.

Referring to FIG. 1, a scissors 2 in accordance with the invention has a substantially straight arm 4 having at one end finger opening 6 and at the other end a tip 8. A second, angled, arm 12 has a thumb opening 14 at one end and a tip 16 at its other end opposite tip 8. The arms 4 and 12 advantageously are of a light plastic material such as, for example, glass-filled polyester.

As best seen in FIG. 3, arm 4 has an integral flange 20 which abuts the outer edge 22 of a metal blade 24 having an inner cutting edge 26. Flange 20 has an inward projection 30 with a forwardly extending nose portion 32 and a sloping rear portion 34 which nests in a complementary opening 36 in blade 24. Flange 20 also has an inwardly extending projection 40 with a forwardly extending nose portion 42 and a rear sloping portion 44 which nests in a complementary opening 46 in blade 24. A finger 50 extends from the forward end of flange 20 over the forward end of blade 24 to retain blade 24 between finger 50 and arm 4. Finger 50 has a stop face 52.

Arm 12 likewise has an identical flange 20 with the same inward projections 30 and 40 and finger 50 cooperating with an identical blade 24 having openings 36 and 46.

An internally threaded bushing 60 (FIG. 7) has a head 62 in a recess 64 in arm 12 and passes through opening 66 in arm 12, opening 68 in the blade 24 adjacent arm 12, opening 70 in the blade 24 adjacent arm 4, and into opening 72. Bushing 60 has opposed flat areas 74 (FIG. 7, only one shown) which abut flat areas **74*a*, 74*a* adjacent opening 72 to cause bushing 60 to turn with arm 4. A screw 76 is threaded into bushing 60 and has an enlarged head 78 received in a recess 80 in arm 4. Screw 76 is slotted as indicated at 82 to permit the use of a coin to turn it. Thus arms 4 and 12 are pivotally secured together with screw 76 and bushing 60 turning with arm 4. This arrangement also acts to hold blades 24 in their nested positions in arms 4 and 12** respectively.

It will be noted that when the arms 4 and 12 are in the closed position, each of the faces 52, 52 of finger 50, 50 meet the inner edge of the blade on the arm not carrying the finger to limit further closing movement.

Contrary to the prior art, it is extremely easy to remove the blades 24. A coin can be used to remove screw 76, permitting arms 4 and 12 to be separated. This also releases the blades 24 which are readily removed by advancing them forwardly causing them to be cammed outwardly and readily removed. New blades are readily inserted by reversing the removal operation and then remating the parts and threading screw 76 into bushing 60. No prying tools or the like are required. Further, while the blades are securely held against movement all of the openings therein are remote from the cutting edge, thus minimizing blade distortion.

It will be understood that the above-described embodiment is illustrative and is not intended to be limiting.

We claim:

1. In a scissors having first and second arms with each arm having a finger receiving portion at one end, the improvement comprising:

a removable metal blade having an outer edge and an inner cutting edge for each arm, the outer edge of each blade having a pair of openings, each opening having a forwardly extending nose portion and a sloping rear portion, a flange on each arm abutting the outer edge of the blade of each arm, a pair of inward projections on each flange, each having a forwardly extending nose portion and a sloping rear portion, engaging the openings in the outer edge of the blade of each arm, a finger extending inwardly from the forward end of each flange and overlying a portion of the blade of each arm, and pivot means passing through the arms and blades for securing the arms and blades together.

2. In a scissors in accordance with claim 1, at least one finger on an arm having a stop face adapted to be engaged by the blade on the other arm.

3. In a scissors in accordance with claims 1 or 2 in which the pivot means comprises a headed bushing and a headed screw having a slot in the head.

4. In a scissors in accordance with claims 1 or 2 in which the pivot means comprises a headed bushing and a headed screw having a slot in the head, said bushing passing through one arm into the other arm, and means for securing the bushing to said other arm for rotation therewith.

5. In a scissors having first and second arms with each arm having a finger receiving portion at one end, the improvement comprising:

a removable metal blade having an outer edge and an inner cutting edge for each arm, the outer edge of each blade having a pair of openings, each opening having a forwardly extending nose portion and a sloping rear portion, a flange on each arm abutting the outer edge of the blade of each arm, a pair of inward projections on each flange, each having a forwardly extending nose portion and a sloping rear portion, engaging the openings in the outer edge of the blade of each arm, a finger extending inwardly from the forward end of each flange and overlying a portion of the blade of each arm, at least one finger on an arm having a stop face adapted to be engaged by the blade on the other arm, and pivot means passing through the arms and blades for securing the arms and blades together comprising a headed bushing and a headed screw having a slot in the head, said bushing passing through one arm into the other arm, and means for securing the bushing to said other arm for rotation therewith.

* * * * *